US008578654B2

(12) United States Patent
Rao et al.

(10) Patent No.: US 8,578,654 B2
(45) Date of Patent: Nov. 12, 2013

(54) FLUSH TYPE WINDOW DRIVE MECHANISM

(75) Inventors: Narendra Somashekhar Rao, Bangalore (IN); Santhosh Karumuri, Inkster, MI (US); Everardo A. Hernandez, Shelby Township, MI (US); Balaji Ramanan, Tamilnadu (IN)

(73) Assignee: Body Systems USA, LLC, Troy, MI (US)

( * ) Notice: Subject to any disclaimer, the term of this patent is extended or adjusted under 35 U.S.C. 154(b) by 356 days.

(21) Appl. No.: 12/434,263

(22) Filed: May 1, 2009

(65) Prior Publication Data

US 2010/0115847 A1 May 13, 2010

(30) Foreign Application Priority Data

Nov. 11, 2008 (IN) ..... 2554/DEL/2008

(51) Int. Cl.
*E05D 15/06* (2006.01)

(52) U.S. Cl.
USPC ..... 49/413; 49/209; 49/360

(58) Field of Classification Search
USPC ..... 49/380, 360, 413, 209, 211, 216
See application file for complete search history.

(56) References Cited

U.S. PATENT DOCUMENTS

| | | | | |
|---|---|---|---|---|
| 5,613,323 | A | 3/1997 | Buening | |
| 5,809,706 | A | 9/1998 | Neaux | |
| 7,073,293 | B2 * | 7/2006 | Galer | 49/413 |
| 7,155,863 | B2 | 1/2007 | Daniel et al. | |
| 7,464,501 | B2 * | 12/2008 | Arimoto et al. | 49/413 |
| 7,934,342 | B2 * | 5/2011 | Lahnala | 49/380 |
| 2002/0148163 | A1 | 10/2002 | Warner et al. | |
| 2009/0183434 | A1 * | 7/2009 | Puotunen | 49/209 |

FOREIGN PATENT DOCUMENTS

| | | |
|---|---|---|
| EP | 0857844 | 8/1998 |
| EP | 1407909 | 4/2004 |
| FR | 2854350 | 11/2004 |

* cited by examiner

*Primary Examiner* — Katherine Mitchell
*Assistant Examiner* — Catherine A Kelly
(74) *Attorney, Agent, or Firm* — Cantor Colburn LLP

(57) ABSTRACT

A window drive mechanism is used to cover and uncover an opening formed in a first window panel. A second window panel is mounted for movement relative to the first window panel. The second window panel is moved by the window drive mechanism between an open position where the opening is uncovered and a closed position where the second window panel covers the opening. When the second window panel is in the closed position, the second window panel is flush with the first window panel. A guide member is mounted for movement with the second window panel and has a notch that defines a first path of movement where the second window panel is moved inwardly of the first window panel. When activated, the drive mechanism moves the second window panel inwardly to a non-flush position via the notch, and then moves the second window panel axially to uncover the opening.

20 Claims, 7 Drawing Sheets

FLUSH TYPE WINDOW DRIVE MECHANISM

CROSS-REFERENCE TO RELATED APPLICATION

This application claims priority to Indian Patent Application No. 2554/DEL/2008, which was filed Nov. 11, 2008.

TECHNICAL FIELD

The subject invention relates to a drive mechanism with a guide feature that moves a first window panel from a flush position with a second window panel to an open position where an opening is uncovered.

BACKGROUND OF THE INVENTION

Rear windows for vehicles, such as pick-up trucks for example, often include a rear window with an opening that is selectively covered and uncovered by a movable window panel to provide ventilation within a cab portion of the pick-up truck. When closed, the movable window panel is positioned within the opening such that the movable window panel is flush with the rear window. The movable window panel is then moved to an offset position, i.e. a non-flush position, to provide ventilation by uncovering the opening. The movable window panel can then be slid along a track to completely uncover the opening.

Such window configurations provide challenges for packaging drive mechanisms to control movement of the movable window panel. Also challenging is maintaining a sealed interface between the rear window and the movable window panel when in a closed position.

SUMMARY OF THE INVENTION

A window drive mechanism is used to cover and uncover an opening formed in a first window panel. A second window panel is mounted for movement relative to the first window panel. The window drive mechanism moves the second window panel between an open position, where the opening is uncovered, and a closed position where the second window panel covers the opening and is flush with the first window panel. A guide member is mounted for movement with the second window panel and has a guide feature that defines a first path of movement where the second window panel is moved inwardly of the first window panel. To uncover the opening, the drive mechanism moves the second window panel inwardly in a first direction to a non-flush position via the guide feature, and then moves the second window panel in a second direction to uncover the opening.

In one example, the drive mechanism is one of a push-pull drive system and a drum and cable drive system. In either configuration, a cable acts to move the guide member.

In one configuration, a seal is included to provide a sealed interface between the first and second window panels when the opening is covered. The seal is fixedly mounted to the first window panel. The seal can be glued to the first window panel, molded to the first window panel, or attached to a carrier mounted to the first window panel, for example.

In one example, the guide member comprises at least one glass guide that includes a notch that defines a first path of movement to move the second window panel to a non-flush position. The second window panel is then moved along a second path of movement to completely uncover the opening. A cursor has a wedge-shaped body with at least one arm portion that is obliquely orientated to the second path of movement. A cable from the drive mechanism is fixed to the cursor, such that the cursor moves in response to driving movement of the cable. The cursor is mounted for movement along a lateral axis defined by upper and lower tracks that are fixed to the first window panel. The glass guide is fixed to an inner surface of the second window panel and includes the notch, which is vertically orientated to receive the arm portion of the cursor. When the drive mechanism is actuated to uncover the opening, the arm portion and the notch cooperate to move the second window panel inwardly relative to the first window panel along the first path of movement. Once in an offset or non-flush position, the drive mechanism then moves the second window panel along the upper and lower tracks, i.e. along the second path of movement, to uncover the opening.

In another example, the guide member comprises a slider that includes a notch having a helical cut surface. The slider has a tubular body that is received within a track fixed to the first window panel. A pin is fixed to the track and is initially received within the notch. To uncover the opening, the drive mechanism drives a cable which is used to move the slider such that a lip from the helical cut surface clears the pin. This moves the second window panel inwardly. Once the pin has been cleared, the drive mechanism then drives the slider to move the second window panel along the track to uncover the opening.

In one example, the first and second window panels, a track assembly, the drive mechanism, and the guide member are assembled together to form a window module. The window module can then be shipped to an installer where the window module can be installed within a vehicle as a unit.

The subject invention provides a simple and efficient drive mechanism for a flush-type window configuration. These and other features of the present invention can be best understood from the following specification and drawings, the following of which is a brief description.

DETAILED DESCRIPTION OF THE PREFERRED EMBODIMENT

Figure 1A:
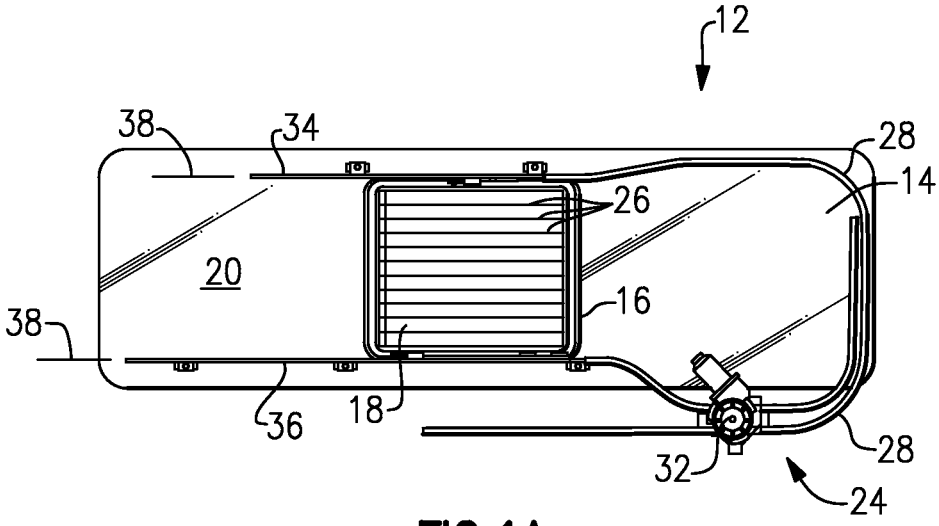
FIG. 1A is an inside view of a window assembly incorporating the subject invention.
Figure 1B:
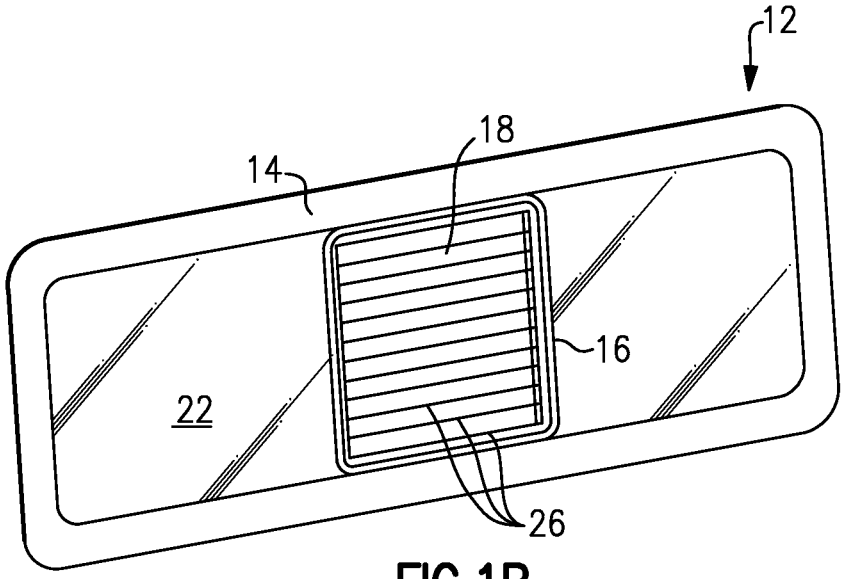
FIG. 1B is an outside view of the window assembly of FIG. 1A.

FIGS. 1A-1B show a window 12 that is installable within a vehicle (not shown), such as a pick-up truck for example. In the example shown, the window 12 is used as a rear window for a pick-up truck. The window 12 includes a first window panel 14 with an opening 16 that is selectively covered and uncovered with a second window panel 18. When the opening 16 is covered, the second window panel 18 is flush with the first window panel 14 as shown from an exterior view, i.e. outside view, in FIG. 1B. In the flush orientation, edges of the opening 16 are aligned with edges of the second window panel 18 such that the second window panel 18 does not protrude beyond an interior surface 20 (FIG. 1A) of the first window panel 14 or an exterior surface 22 (FIG. 1B) of the first window panel 14.

The second window panel 18 is mounted for movement relative to the first window panel 14. A drive mechanism 24 is used to move the second window panel 18 out of a flush position with the first window panel 14 to uncover the opening 16. In the example shown, the first 14 and second 18 window panels are made from glass, with the second window panel 18 including a plurality of de-fog lines 26, however, other window materials and other window types could also be used.

In the example shown in FIGS. 1A-1B, 2A-2B, and 3-7, the drive mechanism 24 comprises a push-pull drive system that includes push-pull cables 28 that are used to move the second window panel 18 relative to the first window panel 14. A motor 32 is mounted within a back panel (not shown) of the vehicle. Upper 34 (FIG. 2A) and lower 36 (FIG. 2B) tracks are mounted to the first window panel 14. The upper track 34 is mounted to extend along at least a portion of an upper edge of the opening 16 and the lower track 36 is mounted to extend along at least a portion of a lower edge of the opening 16. The upper 34 and lower 36 tracks define a path of movement along a lateral axis 38 (FIG. 1A) such that the second window panel 18 can be slid or translated by the drive mechanism 24 along the upper 34 and lower tracks 36 to uncover the opening 16.

Glass guides 40 are fixed to the second window panel 18. The glass guides 40 can be bonded with adhesive or attached to the second window panel 18 by other mounting methods. In the example shown, two glass guides 40 are fixed to a lower edge of the second window panel 18 and a single glass guide 40 is fixed to an upper edge of the second window panel 18. This is just one example configuration, and it should be understood that other configurations could also be used, such as a single glass guide at the lower edge, for example. Each glass guide 40 includes a vertical notch 42 (FIG. 2) that faces, i.e. is open to, a track surface. At least one of the glass guides 40 includes an extension 44 (best seen in FIG. 7) that is received within a corresponding slot 46 formed within one of the upper 34 and lower 36 tracks.

A cursor 50 (FIG. 2B) cooperates with the glass guides 40 and drive mechanism 24 to move the second window panel 18 from a flush position when the opening 16 is covered, to an offset or non-flush position. This will be discussed in greater detail below. The cursor includes a wedge-shaped body 52 and at least one portion that extends from the wedge-shaped body such that the at least one portion is obliquely orientated relative to the lateral axis 38. In the example, shown, the cursor 50 includes first 54 and second 56 arms that extend away from the wedge-shaped body 52.

Figure 3:
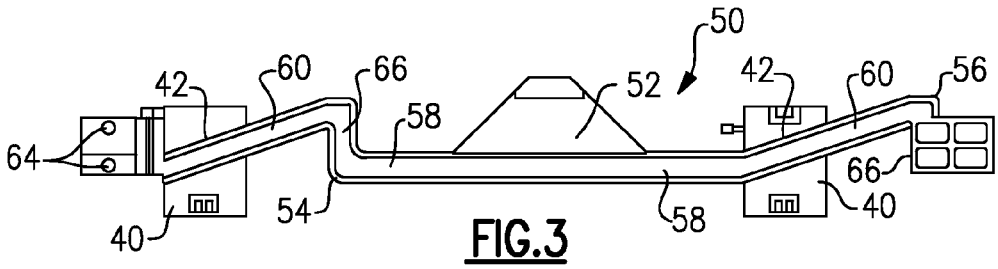
FIG. 3 is a top view of a cursor used in the drive mechanism shown in FIGS. 2A and 2B.

As shown in FIG. 3, each of the first 54 and second 56 arms includes a generally linear portion 58 that extends in a direction generally along the lateral axis 38, and an angled portion 60 that extends obliquely relative to the lateral axis 38. The angled portions 60 are each received within the vertical notch 42 of one of the glass guides 40 and cooperate with each other to define a path of movement for the second window panel 18 that is in a direction generally transverse to the lateral axis 38. As shown in FIG. 3, the vertical notches 42 extend entirely through a body of the glass guides 40 from one edge of the body to an opposite edge. The vertical notches 42 are also obliquely orientated relative to the lateral axis 38 to define an inward path of movement.

The push-pull cable 28 is fixed to the cursor 50 with fasteners 64 (FIG. 3) or by other attachment methods. When actuated by the motor 32, the push-pull cable 28 moves the cursor 50, which cooperates with the vertical notches 42 in the glass guides 40 to pull the second window panel 18 inwardly relative to the first window panel 14.

Figure 2A:
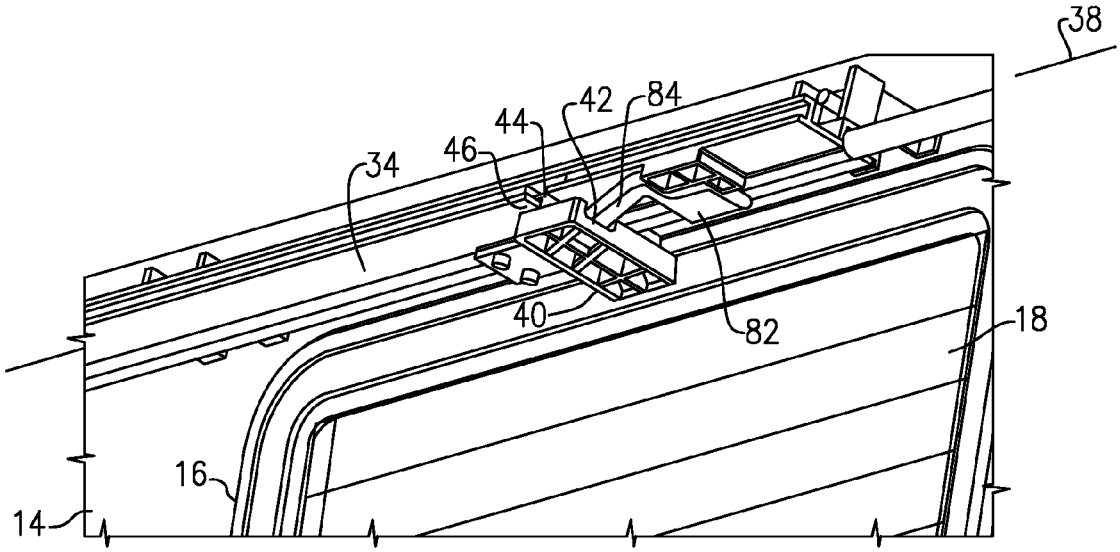
FIG. 2A is a view of one example of an upper track portion of a drive mechanism for covering and uncovering an opening in a first window panel.
Figure 2B:
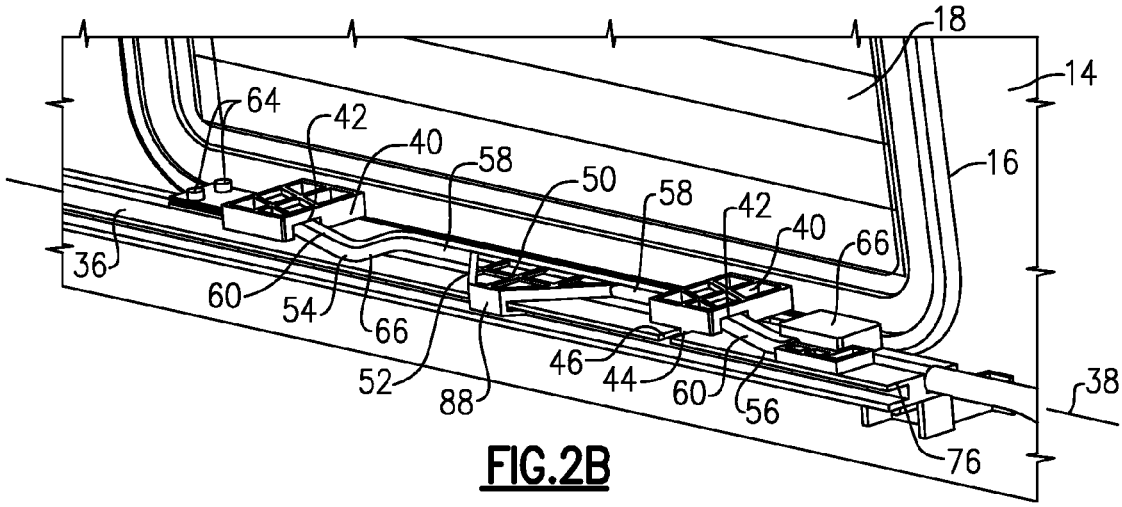
FIG. 2B is a view of a lower track portion of the drive mechanism of FIG. 2A.

FIGS. 2A-2B show the second window panel 18 in a closed position with the opening 16 covered. When in this position, the extension 44 of the glass guide 40 is secured to the lower track 36 within the slot 46 such that the glass guides 40 cannot move in a direction along the lateral axis 38. This is most clearly shown in FIG. 6.

Figure 4:
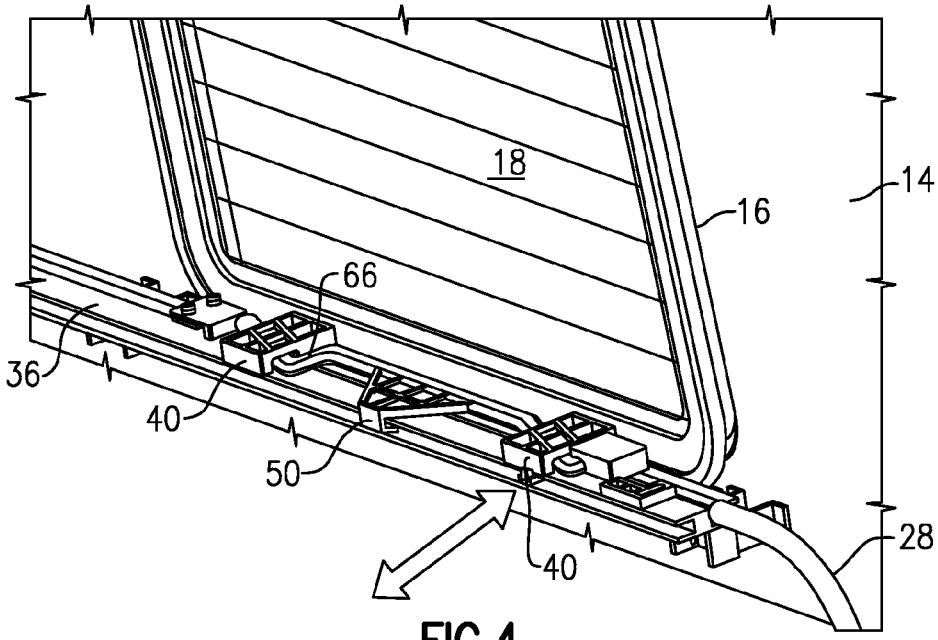
FIG. 4 is a view of the second window panel being initially moved inward to a non-flush position.
Figure 5:
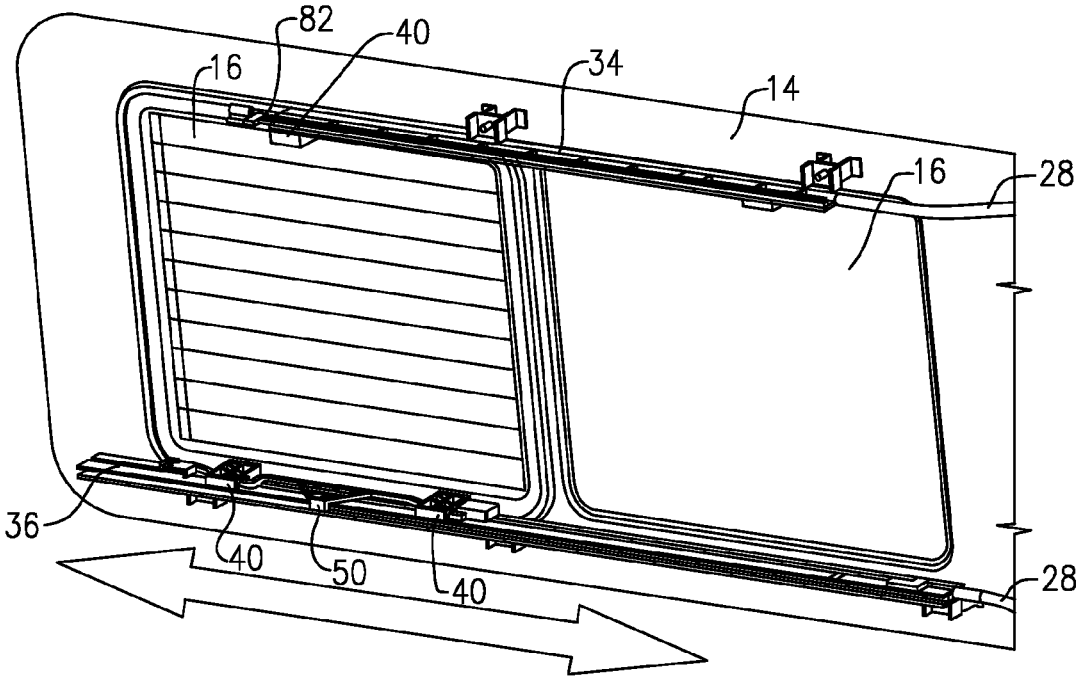
FIG. 5 is a view of the second window panel of FIG. 4 subsequently moved along the first window panel to uncover the opening.

To uncover the opening 16, the push-pull cable 28 pulls the cursor 50 toward the left as viewed in FIG. 2B. This causes the angled portion 60 to be guided within the vertical notches 42, which pulls the second window panel 18 inwardly. This movement of the cursor 50 continues until the glass guides 40 contact a stop 66, as shown in FIG. 4. In this position, the second window panel 18 has been pulled inwardly sufficiently such that the second window panel 18 clears the first window panel 14. Also in this position the extension 44 of the glass guide 40 has been sufficiently moved out of the slot 46 (FIG. 7) such that the second window panel 18 will be free to move in a direction along the lateral axis 38, as shown in FIG. 5, to uncover the opening 16.

Figure 6:
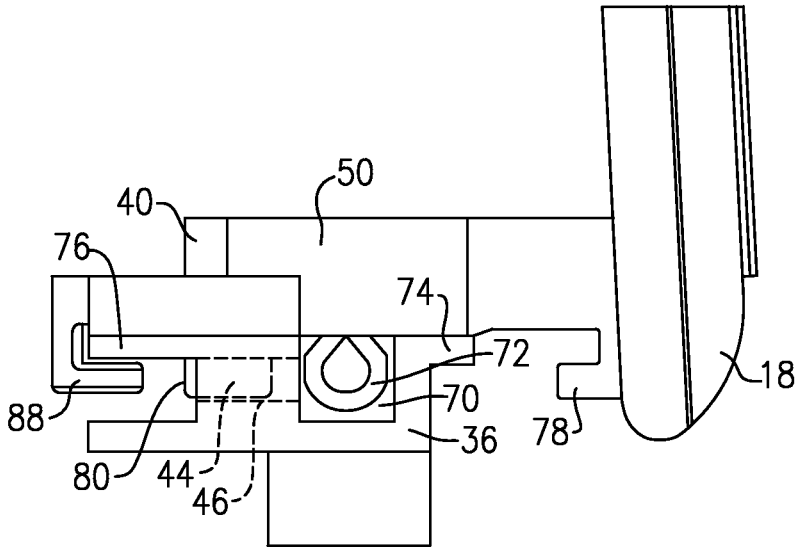
FIG. 6 is a cross-sectional view of the cursor and a track when the opening is covered.
Figure 7:
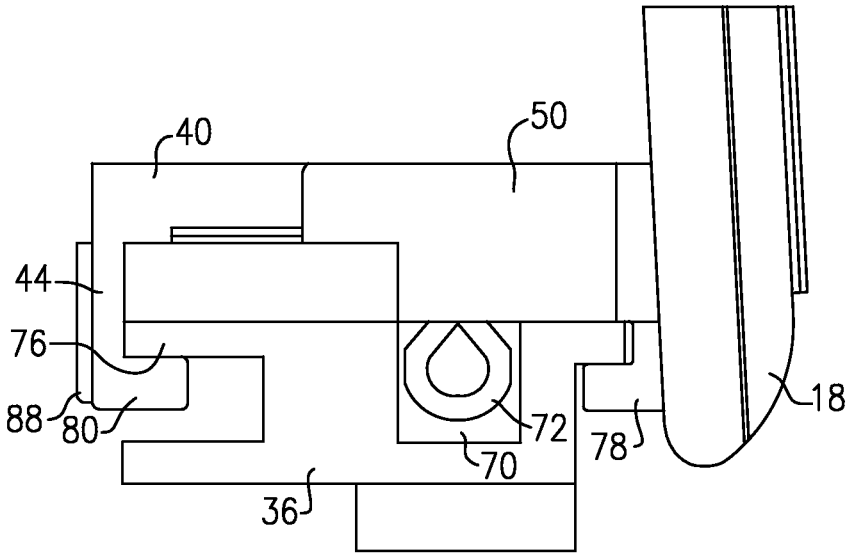
FIG. 7 is similar to FIG. 6 but shows the opening as uncovered.

The lower track 36 is shown in greater detail in FIGS. 6-7. The lower track 36 includes a trough 70 that receives the push-pull cable 28 (FIG. 1A). A cable attachment feature 72 secures the push-pull cable 28 to the cursor 50. The lower track 36 includes a first guide flange 74 and a second guide flange 76. The first 74 and second 76 guide flanges cooperate with first 78 and second 80 guide arms, respectively, of the glass guides 40. The second guide arm 80 includes the extension 44 which is received within the slot 46 in the lower track 36 when the second window panel 18 is in the closed position (FIG. 6). The extension 44 and second guide arm 80 are moved inwardly relative to the first window panel 14, i.e. in a direction to the left in FIGS. 6-7, such that the second guide arm 80 can move freely along the second guide flange 76 to uncover the opening 16. In this position the extension 44 is no longer retained within the lower track 36 as shown in FIG. 7.

Figure 13:
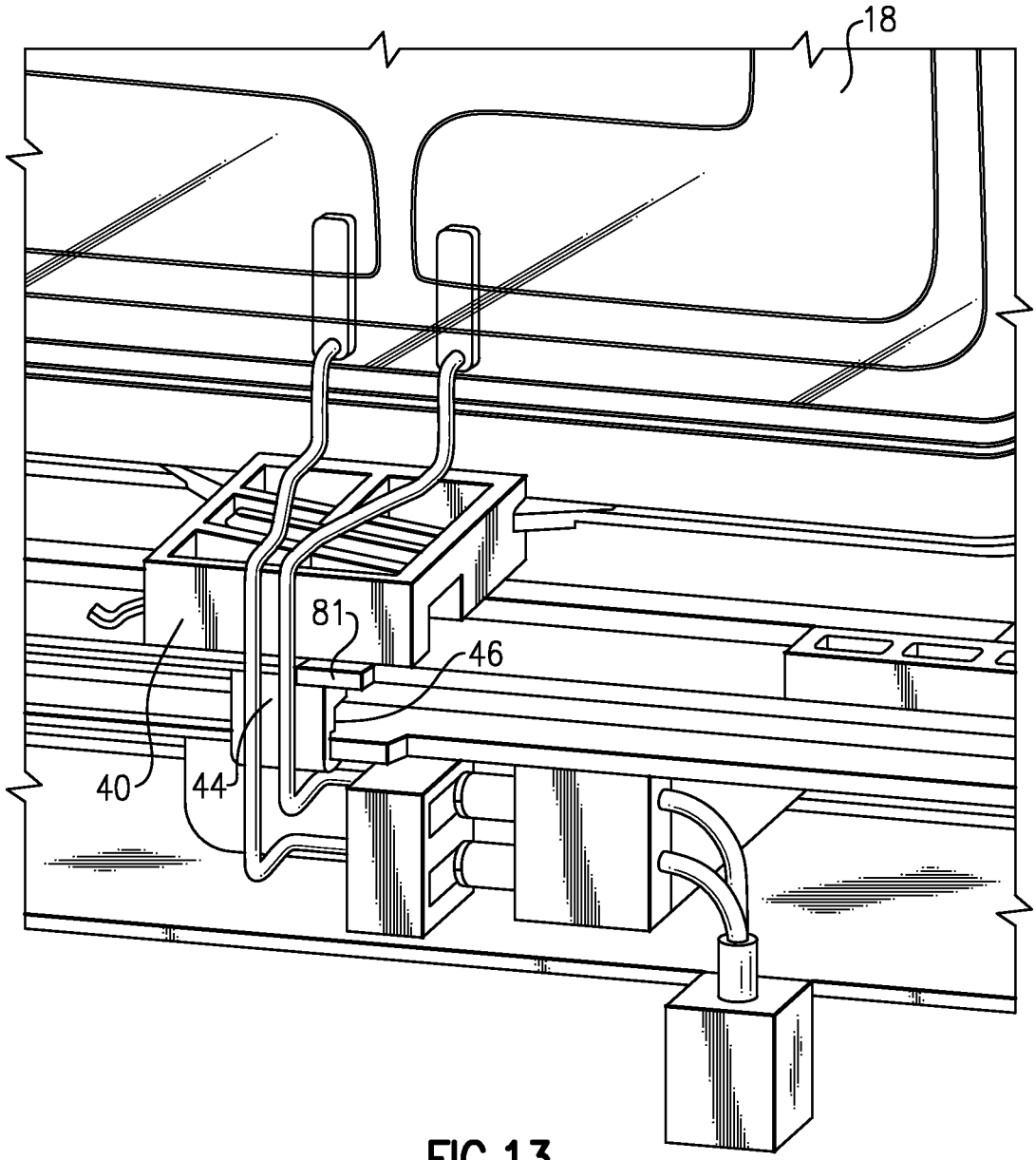
FIG. 13 shows an example of a stop for a glass guide.

An example of a stop interface for the second guide flange 76 is shown in FIG. 13. A stop tab 81 is formed to extend outwardly from an edge of the second guide flange 76. The stop tab 81 stops the glass guide 40 when closing and forces the extension 44 of the glass guide 40 into the slot 46.

The cursor 50 includes an extension arm portion 88 that is received within the second guide flange 76. This is best viewed in FIGS. 2B and 6. The extension arm portion 88 translates along the lower track 36 as the cursor 50 and second window panel 18 move in a direction along the lateral axis 38.

The configuration shown in FIGS. 1A-7 comprises a cursor 50 having two angled portions 60 cooperating with two glass guides 40. The upper track 34 includes a single glass guide 40. A cursor 82 is configured to be similar to the cursor 50; however the cursor 82 only includes one angled portion 84 to be associated with the vertical notch of the single glass guide 40. The upper track 34 is similarly configured as the lower track 36 and the cursor 82 is fixed to an upper push-pull cable 28 in a manner similar to that described above. The push-pull cable 28, the cursor 82, the upper track 34, and the glass guide 40 operate in a manner similar to that described above.

The cursor 50 and drive mechanism 24 provide a simple mechanism that operates to efficiently move the second window panel 18 between open and closed (flush) positions. The cursor 50 is shaped to cooperate with the tracks and glass guides 40 such that the glass guides 40 cannot initially move in any other direction than an inward direction, which forces the second window panel 18 inwardly relative to the first window panel 14. After the initial movement inward, the cursor 50 is in contact with the glass guides 40 such that further movement of the cursor 50 results in movement of the system as a whole along the lateral axis 38 to uncover the opening 16.

While shown as being mounted at a lower edge of the first window panel 14, the drive mechanism 24 can have many different mounting configurations. The drive mechanism can be at one or both lower ends and/or at one or both upper ends, and can be configured as a push-pull drive or a drum and cable drive. An example of a drum and cable drive is discussed in detail below. If a window mechanism is to be driven at both the upper and lower locations, then the same type of drive mechanism should be used at each location. One drive mechanism would be at the lower location and the other drive mechanism would be at the top location with driving being provided at each of the ends to provide sufficient sealing.

On the other hand, if only one drive mechanism is going to be used at a lower or upper location, then a following mechanism is to be used at the other of the upper and lower locations. An example of a follower mechanism is discussed in greater detail below.

FIGS. 8-11 show another example of a drive mechanism 100. In this example, a rail or track 102 is fixed along a lower edge of the opening 16 in the first window panel 14. The track 102 includes a curved inner surface 104 that receives a slider 106. The track 102 also includes a groove or trough 108 within which a pin 110 is fixed.

The slider 106 comprises a tubular member with a center bore 112 and an outer circumferential surface 114 that can slide along the curved inner surface 104 of the track 102. The slider 106 includes a notch comprising a helical cut surface 116 that receives the pin 110. The helical cut surface 116 terminates at a retaining lip portion 118. The slider 106 also includes a mounting interface 120 for a linkage assembly 122.

In the example shown, the linkage assembly 122 includes first 122*a* and second 122*b* links that are pivotally connected to the second window panel 18 and to the slider 106 via first 120*a* and second 120*b* pivot mounts. The second window panel 18 includes a mounting interface 124 to which the first 122*a* and second 122*b* links are attached. The linkage assembly 122 is just one example of a linkage, and other linkage configurations could also be used.

Figure 8:
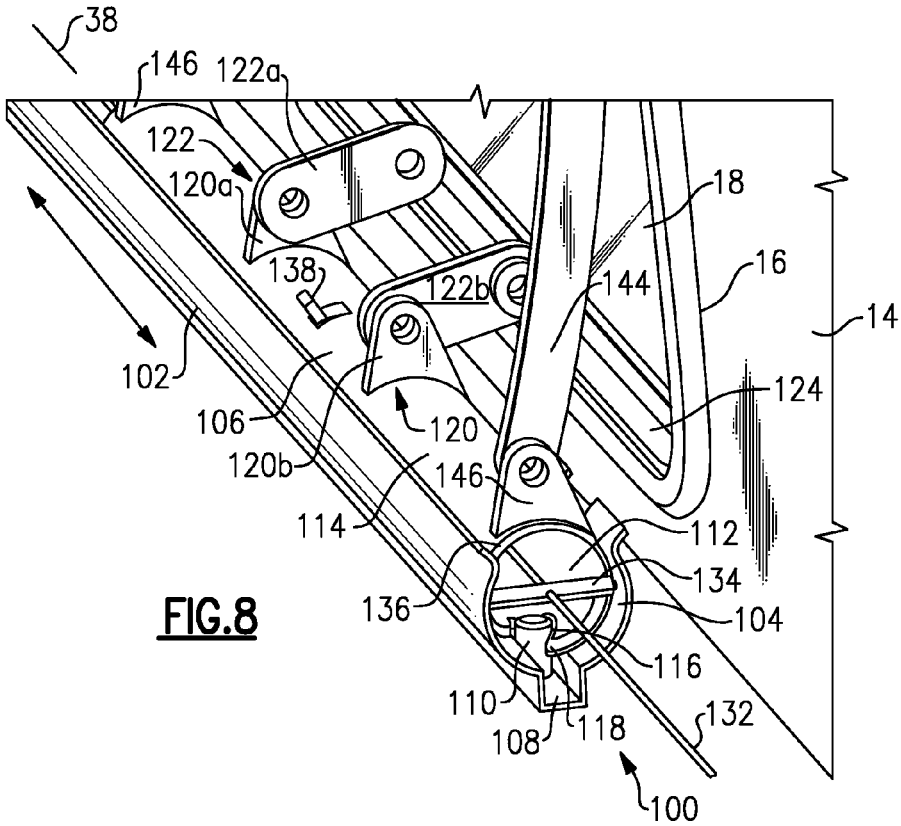
FIG. 8 is another example of a drive mechanism and guide member with the opening in the first window panel being covered.
Figure 9:
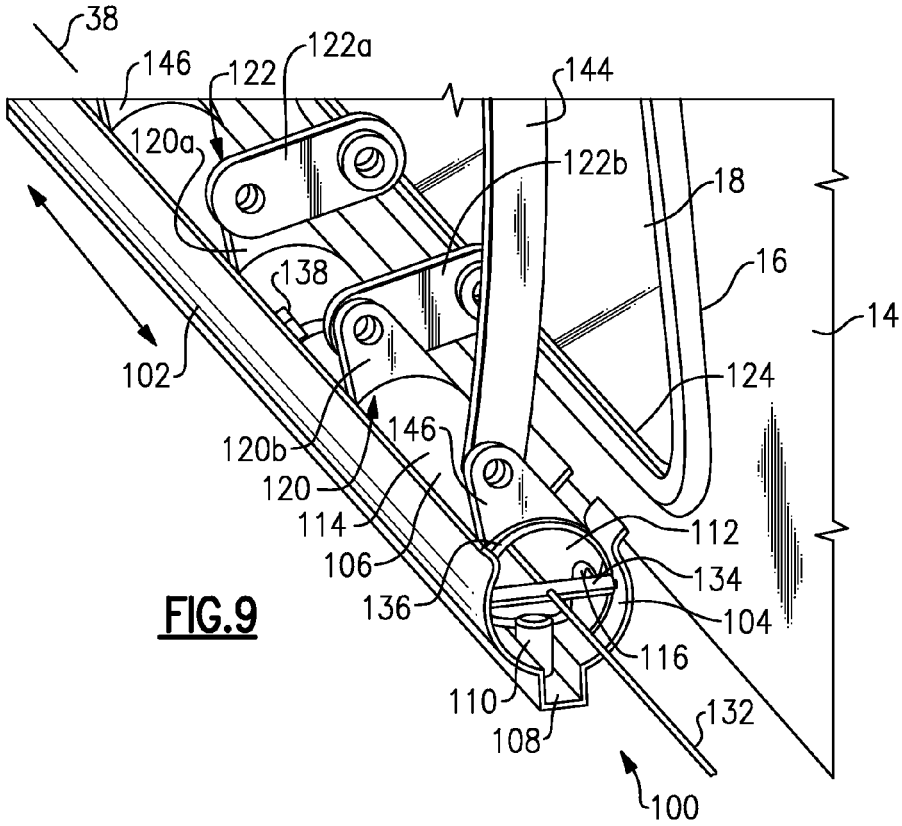
FIG. 9 shows the example of FIG. 8 with the second window panel being moved inwardly.
Figure 10:
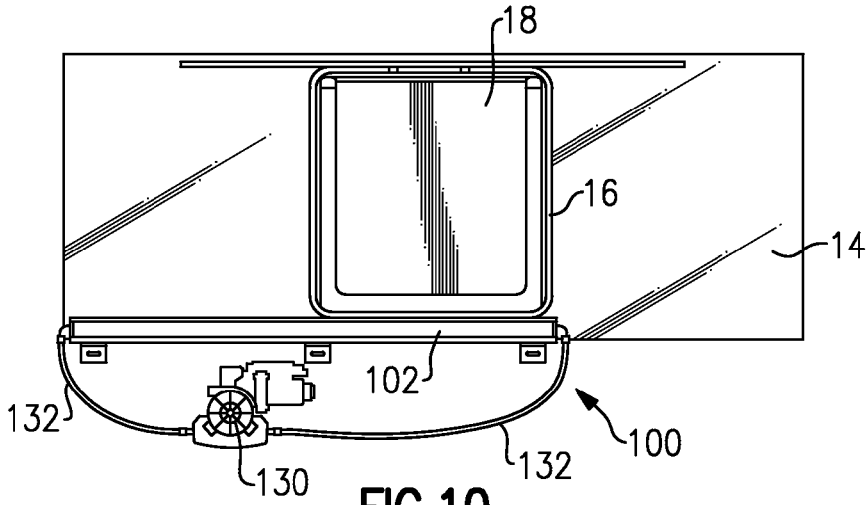
FIG. 10 shows an inside view of the drive mechanism and first and second window panels of FIGS. 8-9.

In this example, the drive mechanism 24 comprises a drum and cable drive 130 as shown in FIG. 10. The drum and cable drive 130 is mounted within the back panel of the vehicle and includes cables 132 that are connected to move the slider 106 back and forth along the track 102. As shown in FIGS. 8-9, a post 134 is fixed to the cable 132. The post 134 engages an end face 136 of the slider 106 at two opposing locations. When the opening 16 is covered, i.e. when the second window panel 18 is in the closed position as shown in FIG. 8, the pin 110 is received within the notch having the helical cut surface 116 and the retaining lip portion 118 prevents the slider 106 from moving in a direction along the lateral axis 38.

To uncover the opening 16, the drum and cable drive 130 drives the cable 132 such that the post 134 exerts a linear force against the slider 106 in a direction along the lateral axis 38. In response to this force, the slider 106 is forced to rotate about the lateral axis 38 as the fixed pin 110 slides along the helical cut surface 116. As the slider 106 is rotated, the linkage assembly 122 pulls the second window panel 18 inwardly along a path that is transverse to the lateral axis 38. Once the slider 106 has rotated sufficiently such that the retaining lip portion 118 of the helical cut surface 116 clears the pin 110, as shown in FIG. 9, the post 134 can then move the slider 106 and the second window panel 18 along the track 102 in a direction along the lateral axis 38 to uncover the opening 16. At least one tab 138 is located on the slider 106 to prevent the slider 106 from rotation during translational movement.

Figure 11:
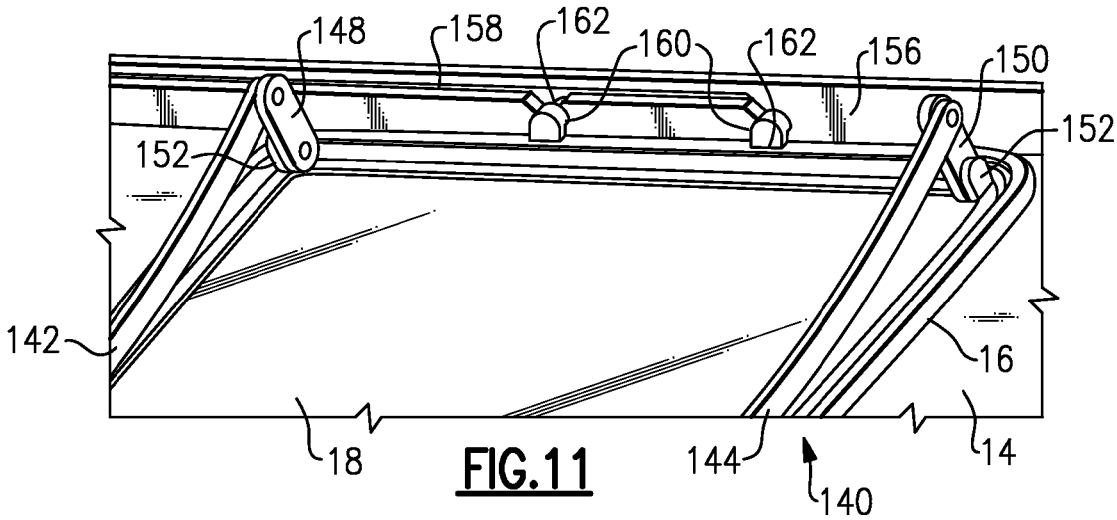
FIG. 11 shows an upper track follower as used with the guide member of FIGS. 8-9.

A similar slider 106 and drive mechanism can be used along an upper edge of the opening 16, or a follower mechanism 140 could be used as shown in FIG. 11. The follower mechanism 140 includes first 142 and second 144 link arms that are pivotally mounted to pivot mounts 146 at opposing ends of the slider 106. First 148 and second 150 links pivotally connect the first 142 and second 144 link arms to pivot mounts 152 that are fixed to the second window panel 18.

An upper track 156 is fixed to the first window panel 14 and extends along an upper edge of the opening 16. The upper track 156 includes a laterally extending slot 158 and a pair of transversely extending slots 160. A pair of pins 162 is fixed to the second window panel 18. When in the closed position, the pins 162 are received within the slots 160 such that the second window panel 18 cannot move in a direction along the lateral axis 38. When the slider 106 is rotated such that the pin 110 clears the helical cut surface 116, the first 142 and second 144 link arms are also rotated, which moves the pins 162 out of the slots 160 to allow the pins 162 to slide freely within the laterally extending slot 158 of the upper track 156. The slots 160 are configured with a ramped portion such that the slider 106 can rotate and translate as needed to clear the helical cut surface 116, without the pins 162 interfering with the translational movement.

The configuration shown in FIGS. 8-11 could also be configured to be used with a push-pull drive system and could be configured with a drive mechanism at an upper location instead of using a follower mechanism.

Figure 12:
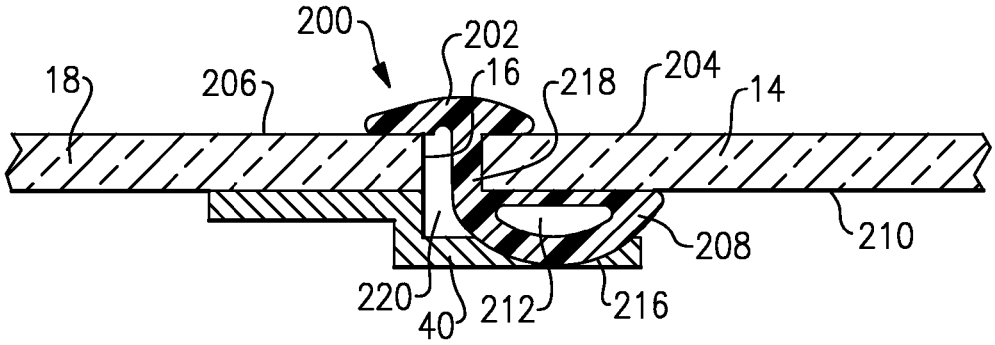
FIG. 12 shows a cross-sectional view of a seal that is used to provide a sealed interface between the first and second window panels when the opening is covered.

A seal 200 is shown in FIG. 12. The seal 200 can be used in any of the examples discussed above. The seal 200 is fixed to the first window panel 14. The seal 200 can be glued to the first window panel 14, molded to the first window panel 14, or attached to a carrier or support (not shown) that is fixed to the first window panel 14, for example. The seal 200 is fixed to the first window panel 14 to surround the opening 16.

The seal 200 includes a first portion 202 that engages exterior surfaces 204, 206 of the first 14 and second 18 window panels, respectively. A second portion 208 of the seal 200 engages an interior surface 210 of the first window panel 14. The second portion 208 comprises a bulb portion with a hollow center 212 and an outer surface 216 that is shown in FIG. 12 as engaging the glass guide 40 when the second window panel 18 is in the closed position. When the second window panel 18 is opened, i.e. moved to the left in FIG. 12, the seal 200 remains fixed to the first window panel 14 and the second window panel 18 and glass guide 40 move out of contact with the seal 200. A third portion 218 of the seal 200 connects the first portion 202 to the second portion 208 and is positioned within a gap 220 formed between the first 14 and second 18 window panels when the opening 16 is covered.

The subject invention provides a simple drive mechanism for a flush type window configuration that operates effectively and efficiently. Further, the drive mechanism for the flush type window configuration is easily assembled and shipped as a sub-assembly such that the sub-assembly can be installed as a single unit. The first and second window panels, the tracks, and the associated drive mechanisms are assembled together to form the sub-assembly. The entire sub-assembly is shipped to an installer where the sub-assembly is subsequently installed as a single unit.

Another advantage with using a window configuration such as that disclosed in the subject invention is material savings. In one example, the first window panel 14 is formed as a single-piece component, and the second window panel 18 is cut out from the first window panel 14, which forms the opening 16. The tracks are then mounted to the first window panel 14, and the second window panel 18, which was previously cut out is reattached to the first window panel 14 by supporting the second window panel 18 for movement along the tracks such that the second window panel 18 can cover and uncover the opening 16.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A window assembly comprising:

a first window panel to be mounted within a vehicle, said first window panel including an opening and having an exterior surface and an interior surface;

a second window panel mounted for movement relative to said first window panel between an open position where said opening is uncovered and a closed position where said second window panel covers said opening, the second window panel having at least one guide member secured thereto;

a guide system for moving the second window panel between the open and closed positions, the guide system having a cursor, the cursor being a single rigid member, wherein a portion of the cursor is slidably received within the at least one guide member, wherein the portion of the cursor is configured to move the second window panel along a first path of movement to move said second window panel between said closed position and an offset position where said second window panel is inwardly and away from said exterior surface of said first window panel; and a drive mechanism cooperating with said guide system to uncover said opening by moving said second window panel inwardly in a first direction along said first path of movement by applying a force to the cursor in a second direction, said second direction being different than said first direction and then moving the second window panel in the second direction by further applying the force to the cursor in the second direction after the second window panel has been moved from the closed position to the offset position such that the second window panel moves along a second path of movement in the second direction, wherein the portion extends obliquely relative to.

2. The window assembly according to claim 1 including a window seal fixedly mounted to said first window panel to provide a seal interface between said first and said second window panels when in said closed position.

3. The window assembly according to claim 2 wherein said window seal includes a first seal portion that engages exterior surfaces of said first and said second window panels when said second window panel is in said closed position, a second seal portion that engages said interior surface of said first window panel, and a third seal portion that connects said first and said second seal portions, and wherein said second seal portion comprises a bulb portion with a hollow center and an outer surface that contacts said guide member when said second window panel is in said closed position.

4. The window assembly according to claim 1 wherein said drive mechanism comprises a push-pull cable drive system.

5. The window assembly according to claim 1 wherein said drive mechanism comprises a drum and cable drive system.

6. The window assembly according to claim 1 wherein said drive mechanism includes a cable that is coupled to the cursor.

7. The window assembly according to claim 1 including an upper track fixed to said window assembly to extend along at least a portion of an upper edge of said opening and a lower track fixed to said window assembly to extend along at least a portion of a lower edge of said opening, said upper and said lower tracks defining said second path of movement.

8. The window assembly according to claim 7 wherein the elongated member of the cursor is slidably received within a notch of the at least one guide member.

9. The window assembly according to claim 8, wherein said notch is vertically orientated with respect to one of said upper and said lower tracks.

10. The window assembly according to claim 9, wherein said at least one guide member is fixed to an inner surface of said second window panel, and wherein said cursor is fixed to a drive member of said drive mechanism, said cursor further comprising a stop surface that engages said at least one guide member when the second window panel is in the offset position such that the at least one guide member and the cursor move in the second direction along the second path of movement when the stop surface engages the at least one guide member.

11. The window assembly according to claim 10 wherein said at least one guide member further comprises an extension that is received within a stop notch formed within one of said upper and said lower tracks when the second window panel is in said closed position, and wherein said extension is moved out of said stop notch when the second window panel is in the offset position.

12. The window assembly according to claim 7 wherein said first window panel, said second window panel, said upper and said lower tracks, said guide member, and said drive mechanism are all assembled together to form a window module, said window module being configured to be installed within the vehicle as a single unit.

13. The window assembly according to claim 1 wherein the second window panel is flush with said first window panel when it is in the closed position.

14. The window assembly as in claim 1, wherein the at least one guide member is a pair of guide members each being secured to the second window panel and spaced from each other and the cursor further comprises a main body member located between the pair of guide members and wherein the portion of the cursor is a pair of portions each extending from opposite sides of the main body member and wherein each the pair of the portions is configured to be slidably received within a respective notch of each of the pair of guide members.

15. The window assembly as in claim 14, wherein the notch of each of the pair of guide members is obliquely orientated with respect to the second direction.

16. The window assembly as in claim 15, wherein the notch of each of the pair of guide members is parallel to the respective portion slidably received therein.

17. The window assembly as in claim 15, wherein each of the pair of guide members further comprises an extension that is slidably received within a stop notch formed within a lower track configured to slidably engage the cursor, the extension being received within the stop notch when the second window panel is in the closed position, and wherein the extension is moved out of the stop notch when the second window panel is in the offset position.

18. The window assembly as in claim 1, wherein the at least one guide member is a lower guide member and the window assembly further comprises an upper guide member configured to slidably receive a portion of an upper cursor as the second window panel moved between the offset position and the closed position.

19. A window assembly comprising: a first window panel to be mounted within a vehicle, said first window panel including an opening and having an exterior surface and an interior surface;

a second window panel mounted for movement relative to said first window panel between an open position where said opening is uncovered and a closed position where said second window panel covers said opening, wherein the second window panel moves along a first path of movement and a second path of movement as it moves between the open position and the closed position, the first path of movement being different from the second path of movement;

a cursor , the cursor being a single rigid member slidably secured to the window assembly;

at least one glass guide mounted to said second window panel, said at least one glass guide including a vertical notch that slidably receives a portion of the cursor therein when the second window panel moves in the first path of movement between said closed position and an offset position wherein said second window panel is inwardly and away from said exterior surface of said first window panel;

an upper track fixed to said window assembly to extend along at least a portion of an upper edge of said opening and a lower track fixed to said window assembly to extend along at least a portion of a lower edge of said opening, said upper and said lower tracks defining the second path of movement where said second window panel is moved from said offset position to said open position; and a drive mechanism including a drive member that is fixed to movably drive said cursor, the portion of said cursor being configured to move said second window panel between said closed and said offset positions when the drive mechanism moves the cursor in a first direction and wherein further movement of the cursor in the first direction after the second window panel is in the offset position causes the second window panel to move in the second path of movement in the first direction, wherein the portion extends obliquely relative to the second direction.

20. The window assembly according to claim 19 wherein said at least one glass guide comprises at least a first glass guide mounted to a lower edge of said second window panel and a second glass guide mounted to said lower edge of said second window panel and axially spaced apart from said first glass guide, said first glass guide including the vertical notch and said second glass guide including a second vertical notch, the vertical notch and the second vertical notch are each obliquely orientated relative to said second path of movement, and wherein the elongated member of said cursor includes a first arm that is received within the vertical notch and a second arm that is received within the second vertical notch.

* * * * *